United States Patent [19]

Kanda et al.

[11] 4,006,719

[45] Feb. 8, 1977

[54] VORTEX ACTION FUEL INJECTION VALVE FOR INTERNAL COMBUSTION ENGINE

[75] Inventors: Fumio Kanda, Ogawa; Kousei Nakajima, Hanazono, both of Japan

[73] Assignee: Diesel Kuki Co., Ltd., Tokyo, Japan

[22] Filed: Feb. 18, 1975

[21] Appl. No.: 550,798

[30] Foreign Application Priority Data

Feb. 19, 1974 Japan ..... 49-19338[U]

[52] U.S. Cl. ..... 123/32 JV; 123/33 E; 239/403; 239/405

[51] Int. Cl.² ..... F02B 3/00

[58] Field of Search ..... 123/33 E, 32 JV, 33 B, 123/33 C, 139 AW; 239/403, 405, 88

[56] References Cited

UNITED STATES PATENTS

| | | | |
|---|---|---|---|
| 1,363,470 | 12/1920 | Knudsen | 239/405 |
| 1,457,849 | 6/1923 | Morse | 239/405 |
| 3,095,153 | 6/1963 | Soth | 239/403 |
| 3,782,639 | 1/1974 | Boltz | 239/405 |

*Primary Examiner*—Ronald B. Cox

*Attorney, Agent, or Firm*—Sughrue, Rothwell, Mion, Zinn & Macpeak

[57] ABSTRACT

An air vortex chamber is provided downstream of the valve seat portion of a fuel injection valve body such that the fuel injecting from the valve seat portion collides with the inner wall of the vortex chamber in a plane coincident with a plurality of tangential air passages which introduce air into the vortex chamber and create the vortex action.

4 Claims, 2 Drawing Figures

FIG. 1
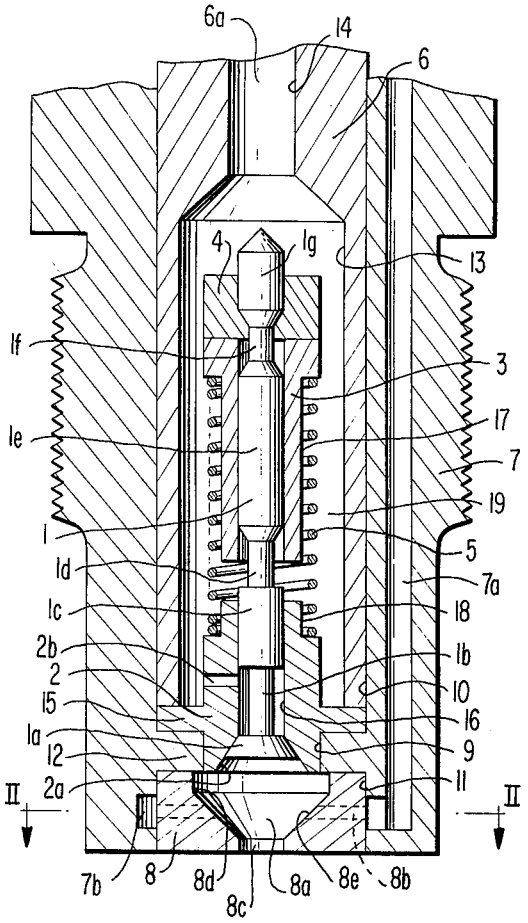
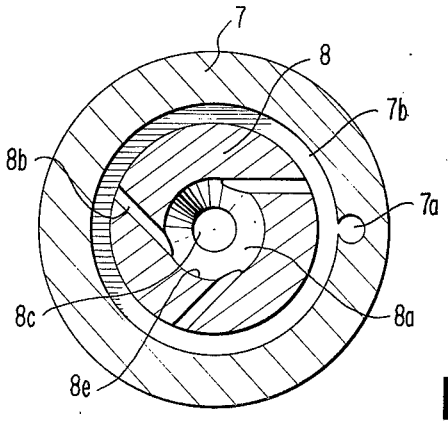
FIG. 2

VORTEX ACTION FUEL INJECTION VALVE FOR INTERNAL COMBUSTION ENGINE

BACKGROUND OF THE INVENTION

Field of the Invention

This invention relates to fuel injection valves for internal combustion engines, and more particularly to an outwardly opening type fuel injection valve for gasoline engines.

Description of the Prior Art

In manifold injection type internal combustion engines, particularly those fueled with gasoline, the injected spray adheres to the wall of the manifold and the atomization of the fuel is not assured, thus causing an increase in the quantity of hydrocarbons in the exhaust gas so that such manifold injection type fuel injection valves are not desirable. Further, where fuel injection valves inject directly into the cylinder, the injected spray adheres to the cylinder wall, and since the temperature of the cylinder wall is relatively low, the fuel adhering to the cylindrical wall is difficult to burn and causes an increase in the quantity of hydrocarbons in the exhaust. Thus, fuel injection valves injecting directly into the cylinders are undesirable for these reasons.

On the other hand, in order to promote the atomization of the fuel, there is provided a device wherein an air chamber is formed at the discharge end of an open injection nozzle and an air throttle is provided at the outlet of the air chamber. In this type of device, however, since the velocity is increased for atomization at the throttle portion, there is the drawback that the desirable point of arrival of the injected spray is such that the travel distance can not be shortened.

In the present invention, an air vortex chamber which generates a whirlpool or vortex action by movement of the air, is provided at the discharge end portion of the valve body which valve opens under application of fuel pressure, thus causing the fuel to hit on the inner wall of the air vortex chamber, and the fuel is carried on the air vortex whereby atmoization of the fuel is improved, and furthermore, the injection speed is decreased, thus the drawbacks which are intrinsic to the conventional outwardly opening type fuel injection valve is eliminated.

SUMMARY OF THE INVENTION

The invention is directed to a fuel injection valve for an internal combustion engine which comprises a valve body having a central bore, an annular valve seat mounted within said bore at one end of said body, said annular valve seat having a central opening therein including a diverging terminal portion directed axially outward of said body. A needle valve is slidably mounted within the valve body and has one end slidably and sealably positioned within the annular valve seat central opening. The needle valve terminates in a radial flange portion having an outwardly tapered face which mates with a diverging terminal portion of the valve seat central opening. Means spring bias the needle valve towards closed position but permit the pressure of the fuel to act on the needle valve to open the same against the pressure of the bias means.

The improvement resides in means which define an air vortex chamber immediately downstream of the valve seat and the needle valve flange, said vortex chamber including a converging inner wall in the direction away from the valve seat such that the fuel injection from the opening formed between the diverging valve seat wall portion and the needle valve flange collides with the vortex chamber inner wall. A plurality of air passages open into the vortex chamber tangentially to introduce air from the exterior under pressure and to cause a vortex movement of the air within the vortex chamber.

The inner wall of the vortex chamber is preferably of a converging frustoconical form in the flow direction.

BRIEF DESCRIPTION OF THE DRAWINGS

FIG. 1 is a vertical sectional view of one embodiment of the improved fuel injection valve for internal combustion engines of the present invention.

FIG. 2 is cross-sectional view of portion of the fuel injection valve of FIG. 1 taken about line II — II.

DESCRIPTION OF THE PREFERRED EMBODIMENT

Reference to the drawings illustrates a preferred embodiment of the present invention in which the cylindrical valve body 7 is provided with a bore 9 and a pair of counterbores 10 and 11 above and below bore 9 of essentially the same diameter and defining an annular, internal radial flange therebetween. A cylindrical passage member 6 is mounted within the upper counterbore 10 and is provided with a bore 14 and a counterbore 13 with the lower end of the passage member 6 abutting a radially enlarged portion 15 of valve seat member 2 which is also annular in form. The annular valve seat member which is cylindrical in form sealably fits within the lower end of passage member 6, the valve seat member 2 being provided with a bore 16 which extends the length of the same and which terminates in a tapered portion at the bottom which is frustoconical in cross-section and forms an outwardly tapering valve seat 2*a*. A needle valve indicated generally at 1 is slidably supported within the valve seat member 2 having a large diameter portion 1*c* of slightly less diameter than the bore 16 of the valve seat member 2. The needle valve is further formed from the bottom upwardly, with a mating tapered valve portion 1*a* which mates with the valve seat 2*a* of valve seat member 2, a small diameter portion 1*b* connecting the valve portion 1*a* to large diameter portion 1*c*, a further small diameter portion 1*d*, a further large diameter portion 1*g* equal in diameter to portion 1*c*, a small diameter portion 1*f* and at the upper end a large diameter portion 1*g*. As mentioned, the large diameter portion 1*c* slidably fits in an oil tight manner within the bore 16 of the valve seat member 2, and the valve portion 1*a* is in oil tight contact with the valve seat portion 2*a* at the lower end of the valve seat member 2, a cylindrical upper spring holding member 3 receives the upper end of the needle valve 1, the large diameter portion 1*e* fitting into the upper spring holding member 3 and the upper extent of the movable upper spring holding member 3 being determined by coupling member 4 which engages the large diameter portion 1*g* of the needle valve and limits by way of the reduced diameter portion 1*f*, the extent of displacement of the upper spring holding member 3 with respect to the needle valve 1 in an axial direction. The outer periphery of the upper spring holding member 3 is recessed annularly as at 17 and an annular recess 18 is provided on the upper end of the valve seat member 2. A coil spring 5 is compressibly carried between the valve seat member 2 and the upper spring holding member 3 and biases the needle valve 1 towards valve closed position and the upper spring holding member 3 away from the valve seat member 2. A radial through hole 2*b* which opens up into annular space 19 formed by the counterbore 13 of the passage member 6 extends to the bore 16 of the valve seat member 2, through which the small diameter portion 1*b* of needle valve 1 extends. Thus, oil within space 19 may flow through the through hole 2*b* and into the bore 16 of the valve seat member and escape between the passageway formed by the opposed mating conical faces of the valve seat 2*a* and the valve portion 1*a* of the needle valve. A longitudinal air passage 7*a* extends within passage member 6, and by way of an annular air distribution passage 7*a* within the valve body 7, air enters a plurality of circumferentially spaced, small diameter air passages 8*b* within an annular air vortex chamber body 8 which has an outside diameter on the order of counterbore 11 within the bottom end of the valve body 7 and which is sealably inserted therein to the extend of abutting against radial flange 12. The small diameter passages 8*b* open into a central vortex chamber 8*a* within air vortex chamber member 8 which lies below the conical valve seat 2*a*. The air vortex chamber 8*a* is provided with an inner wall in the form of three joined wall portions, in a direction away from the valve seat member 2 constituted by a large diameter wall portion 8*d* of short axial length, a conical, inwardly tapering wall portion 8*e* and a small diameter wall portion 8*c* at the outlet or discharge end of the air vortex chamber member 8. In this respect, the small diameter air passages 8*b* which pass through the air vortex chamber member 8 from the annular air passage 7*b* to the vortex chamber 8*a* exit or open into the vortex chamber 8*a* tangentially to the wall 8*e* at a position which approximately coincides with that position where the injected fuel hits against the wall 8*e* of the vortex chamber upon opening of the needle valve 1.

In operation of the fuel injection valve, fuel under pressure enters fuel passage 6*a* defined by bore 14 within the passage member 6 and fills space 19, the fuel acting against the large diameter portion 1*g* of the needle valve 1 and against the upper, axial end wall of the coupling member 4 tending to compress the coil spring 5 and thus moving the tapered valve flange 1*a* away from the mating tapered conical valve seat 2*a*. Simultaneously, air under pressure supplied through air passage 7*a* by means (not shown) in synchronism with the pressure feeding of the fuel (a continuous stream may also be used) causes the air to enter the vortex chamber tangentially at high speed and impinge against the converging tapered wall 8*e* of the vortex air chamber member 8. Where due to the pressure-feeding of fuel injection pump (not shown), the fuel pressure entering fuel passage 6*a* and forming a fuel pool within space or chamber 19, the action of the air pump (also not shown) which supplies air to the air vortex chamber 8*a* to the air passages 8*b* in synchronism therewith, causes a highly desirable atomization and mixing of the air and fuel prior to discharge from the small diameter opening 8*c* at the bottom of the air vortex chamber. Thus, when the fuel pressure is increased within space 19 and the effect of the fuel pressure exceeds the force of the biasing of the compression spring 5, the needle valve 1 moves away from the valve seat and the fuel in the fuel pool is injected by way of passage or through hole 2*b* circumferentially into the air vortex chamber 8*a* by the space formed between the mating conical surfaces of the needle valve 1 and the valve seat member 2. The fuel injected into the air vortex chamber 8*a* collides with the wall 8*e* of the air vortex chamber 8*a*, whereby the speed of the moving fuel is reduced, the fuel becomes readily mixed with the air and moves in the direction of the air vortex since it is carried thereby and at the same time becomes atomized. Thus, by whirling of the air vortex, atomization of the fuel is promoted and mixture of the fuel and air enhanced, subsequently, it is injected from the small diameter injection nozzle 8*c*. When the fuel pressure within the pool or space 19 becomes weaker than the force of the spring 5, the injection of fuel is interrupted.

As described above, the injection valve according to the present invention causes the injected fuel once colliding with the wall, to be reduced in speed, enables it to be readily entrained on the air vortex, promotes the atomization of the fuel and causes it to inject from the injection nozzle at a spray velocity which is reduced, but wherein full atomization of the fuel within the spray is readily attained. Thus, contrary to the conventional injection valve, the fuel and air mixture leaving the injection nozzle 8*c* does not hit upon the wall when the valve is employed in manifold injection or the cylinder wall when the injection valve is employed in a cylinder injection scheme. Since the spray particles are small, the vaporization of fuel is promoted and all of the injection fuel participates in combustion, so the injection system acts as a counter measure for hydrocarbon pollution by way of the exhaust gases.

Furthermore, by changing the shape, length, diameter of the vortex chamber, whether or not the vortex chamber includes a converging conical portion, and by varying the angle of the air passage holes which are illustrated as being tangential to the wall adjacent the point of injection of the air into the vortex chamber, the shape of the spray is changed, and it is possible to obtain various spray forms as required by specific engines.

Although the present invention is described with reference to a poppet valve of the outwardly opening type, it is evident that the same effect may be obtained when the present invention is employed in fuel injection valves of the hole type, pintle type, throttle type, etc.

While the invention has been particularly shown and described with reference to a preferred embodiment thereof, it will be understood by those skilled in the art that various changes in form and details may be made therein without departing from the spirit and scope of the invention.

What is claimed is:

1. In a fuel injection valve for an internal combustion engine which includes a valve body terminating at one end in an annular, diverging valve seat wall in a direction, axially outward of said body, a needle valve slidably mounted within the valve body and terminating in an enlarged radial flange portion having an outwardly diverging surface which mates with the diverging annular valve seat wall and forms therebetween an annular gap when said needle valve flange portion moves outwardly and away from said valve seat wall, means for supplying liquid fuel under pressure to said needle valve for flow through said gap, and means spring biasing the needle valve towards closed position, the improvement comprising: an annular member constituting an axial extension of said valve body, downstream of said valve seat wall and including a circular wall extending circumferentially about said annular valve seat and radially outwardly therefrom and forming an air vortex chamber such that fuel injection through the gap formed between the diverging valve seat wall and said needle valve flange portion collides with the vortex chamber inner wall, said circular wall including a lower wall portion which converges axially away from said needle valve and a plurality of circumferentially spaced air passages within said annular member opening tangentially into the vortex chamber in said lower wall portion at a plane which coincides with the line of impact of the fuel injected through said gap onto the vortex chamber wall; whereby said plurality of air passages creates a uniform high speed vortex within said vortex chamber, and wherein fuel impingement in the plane of entry of said tangential air passages significantly decreases the velocity of the fuel and promotes improved atomization of the fuel within the vortex air stream.

2. The fuel injection valve as claimed in claim 1, wherein said vortex chamber annular member comprises an annular body whose inner wall includes in order and joined from the flange portion of said needle valve outwardly, a first wall portion whose diameter is larger than the diameter of said needle valve flange portion which is relatively short in axial length, a second converging wall portion which is frustoconical in cross section and is of substantial axial length, and a short length wall portion of a diameter less than that of said needle valve flange portion forming the discharge opening for said fuel injection valve and wherein said air passages open into said vortex chamber through said second wall portion.

3. The fuel injection as claimed in claim 1, wherein said valve body comprises a longitudinal air passage parallel to and radially outwardly of said bore and counterbore, said longitudinal passage being closed off at the end of the passage adjacent the air vortex chamber, an annular air distribution chamber surrounding said annular member forming said air vortex chamber and open to said longitudinal air passage and to said plurality of circumferentially spaced air passages witin said annular member opening tangentially into the vortex chamber; whereby, said annular passage promotes uniform distribution of said pressurized air to said plurality of circumferentially spaced air passages to further promote a uniform vortex movement of air within said vortex chamber and uniform atomization of the fuel injected into said vortex air stream.

4. The fuel injection valve as claimed in claim 2, wherein said valve body comprises a longitudinal air passage parallel to and radially outwardly of said bore and counterbore, said longitudinal passage being closed off at the end of the passage adjacent the air vortex chamber, an annular air distribution chamber surrounding said annular member forming said air vortex chamber and open to said longitudinal air passage and to said plurality of circumferentially spaced air passages within said annular member opening tangentially into the vortex chamber; whereby, said annular passage promotes uniform distirbution of said pressurized air to said plurality of circumferentially spaced air passages to further promote a uniform vortex movement of air within said vortex chamber and uniform atomization of the fuel injected into said vortex air stream.

* * * * *

UNITED STATES PATENT AND TRADEMARK OFFICE

CERTIFICATE OF CORRECTION

PATENT NO. : 4,006,719

DATED : Feb. 8, 1977

INVENTOR(S) : Fumio Kanda and Kousei Nakajima

It is certified that error appears in the above-identified patent and that said Letters Patent are hereby corrected as shown below:

Please correct the spelling of the second word in the name of the assignee from [Kuki] to --- Kiki --- so that the name of the assignee reads Diesel Kiki Co., Ltd.

Signed and Sealed this

Third Day of May 1977

[SEAL]

*Attest:*

RUTH C. MASON
*Attesting Officer*

C. MARSHALL DANN
*Commissioner of Patents and Trademarks*